US005469609A

United States Patent [19]

Beifuss

[11] Patent Number: 5,469,609

[45] Date of Patent: Nov. 28, 1995

[54] YARN TEXTURING APPARATUS

[75] Inventor: Horst Beifuss, Wermelskirchen, Germany

[73] Assignee: Barmag AG, Remscheid, Germany

[21] Appl. No.: 275,633

[22] Filed: Jul. 15, 1994

[30] Foreign Application Priority Data

| | | | |
|---|---|---|---|
| Jul. 15, 1993 | [DE] | Germany | 43 23 664.2 |
| Feb. 17, 1994 | [DE] | Germany | 44 04 975.7 |
| Mar. 17, 1994 | [DE] | Germany | 44 09 038.2 |

[51] Int. Cl.[6] ..... D02G 1/16

[52] U.S. Cl. ..... 28/271; 28/247

[58] Field of Search ..... 28/250, 271, 272, 28/274, 275, 276, 277, 278, 247, 248, 258, 264, 273; 57/333, 350

[56] References Cited

U.S. PATENT DOCUMENTS

| | | | |
|---|---|---|---|
| 3,293,844 | 12/1966 | Wininger et al. | 28/276 |
| 4,667,380 | 5/1987 | Symon | 28/271 |
| 5,088,168 | 2/1992 | Berger et al. . | |

FOREIGN PATENT DOCUMENTS

| | | |
|---|---|---|
| 0256448 | 2/1988 | European Pat. Off. . |
| 2632082 | 1/1978 | Germany . |

*Primary Examiner*—C. D. Crowder
*Assistant Examiner*—Larry D. Worrell
*Attorney, Agent, or Firm*—Bell, Seltzer, Park & Gibson

[57] ABSTRACT

A yarn texturing apparatus which comprises a nozzle having a passageway through which the yarn is advanced, and a duct system for introducing heated air into the passageway. A perforated stuffer box is disposed adjacent the outlet end of the passageway. The duct system for the heated air includes an annular duct surrounding the passageway, and a supply duct communicating with the annular duct. Also, an adjustable deflector is mounted in the supply duct immediately adjacent the annular duct for imparting a circumferential component to the heated air as it enters the annular duct, and which in turn imparts a slight twist to the advancing yarn so as to facilitate its smooth advance.

18 Claims, 8 Drawing Sheets

YARN TEXTURING APPARATUS

BACKGROUND OF THE INVENTION

This invention relates to an apparatus for texturing an advancing yarn, and which includes a nozzle wherein a pressurized heating fluid, such as hot air, is brought into contact with the advancing yarn, and a perforated stuffer box is disposed adjacent the outlet end of the nozzle for forming the yarn exiting from the nozzle into a compressed plug.

Texturing nozzles of the described type are known from DE 26 32 082, EP 256 448, and U.S. Pat. No. 5,088,168. In these texturing nozzles, the nozzle includes an annular duct which surrounds the yarn passageway, and a conical duct which leads from the annular duct to the yarn passageway. The heated air is delivered into the annular duct so that it proceeds via the conical duct into the yarn passageway. However, the heated air tends to form turbulences in the annular duct and the conical duct which is adjacent thereto. Such turbulences lead to a twisting of the yarn. It is then not possible to crimp the yarn to an adequate extent in the subsequent stuffer box. On the other hand, however, a slight twist formation is desired, so that the yarn advances smoothly. To produce clear conditions, a preferred direction of twist is predetermined by the layout of the annular duct. This again results in that in certain applications, the twist insertion is too strong, and does not permit an adequate crimping. In a multi-position texturing machine, it is also desired that the twist formation of all texturing nozzles be identical. This necessitates a very fine adjustment of all texturing nozzles, which can be carried out only by highly qualified personnel with good knowledge and experience.

It is accordingly an object of this invention to construct a texturing nozzle such that it allows a totally twistfree texturing, but avoids differences in texturing from production station to production station during its operation, by providing that each texturing nozzle is controllable and adjustable.

SUMMARY OF THE INVENTION

The above and other objects and advantages of the present invention are achieved by the provision of a yarn texturing apparatus which comprises a nozzle including a passageway through which the yarn is to advance at high speed from an inlet end to an outlet end, and duct means for conducting a pressurized heating fluid into the passageway during operation of the apparatus. The duct means includes an annular duct surrounding the yarn passageway in said nozzle, a supply duct communicating with the annular duct, and the conical duct extending from the annular duct to the yarn passageway. A perforated stuffer box is disposed adjacent the outlet end of the yarn passageway for receiving and forming a compressed plug from the advancing yarn exiting from the passageway. Also, in accordance with the present invention, means are provided in the supply duct for adjustably controlling the predominant direction of flow of the heating fluid into the annular duct.

One advantage of the invention is that while basically all nozzles can be designed for optimal and twistfree processing, it is nonetheless desirable to be able to eliminate differences in the twist insertion from station to station by the adjustment of each nozzle during operation.

In one preferred embodiment, the direction controlling means comprises a generally flat baffle plate which is mounted for rotation about a pivotal axis which is parallel to the direction of the yarn passageway. This construction offers the advantage of influencing also the velocity of the hot air along with the adjustment of the direction of its inflow.

The pivotal axis of the flat baffle plate may be located adjacent the downstream end of the plate. This offers the advantage that, along with the increasing deflection of the inflowing hot air, an increasing portion of the arriving hot air current is caught and deflected.

This advantage is achieved in that the baffle plate or deflector points upstream with its movable end. This allows the deflector to block the free cross section of the supply duct only such that the "stream lines" of the hot air impacting upon the deflector are deflected with a directional component in direction toward the intended twist insertion. The formation of dead zones between the impact surface of the deflector and the supply duct is avoided with certainty.

The axis of rotation of the flat baffle plate is preferably arranged in the supply duct immediately adjacent the annular duct. This construction contributes to a substantially lossfree entry of the hot air into the annular duct directly after the twist insertion. It is preferred to arrange the axis of rotation at the end of the deflector, so that the angular position of the deflector establishes the direction of inflow at its end related to the axial direction of the arriving flow.

The direction controlling means may also be constructed as a rotatable pin, whose axis of rotation is arranged such that it extends parallel to the central axis of the annular duct. Through the pin a radial bore extends, which lies parallel to the axis of the supply duct for the hot air. The axis of the supply duct itself extends perpendicularly to the axis of the rotatable pin, i.e., the air flows through the radial bore of the pin and enters then into the annular duct.

In this arrangement, the diameter of the radial bore of the pin on the inlet side will correspond for flow reasons (i.e. the avoidance of losses) substantially to the diameter of the supply duct of the hot air stream. It may however be also made greater than the supply duct for the hot air stream, so as to ensure in the rotated arrangement a lossfree entry from the supply duct into the radial bore of the pin. Likewise, it is conceivable that the radial bore has on its outlet side either the same diameter as on the inlet side or a smaller diameter. Such a conical radial bore may be utilized for structurally influencing the flow in the annular duct.

In any rotated position of the pin, the outlet side of the radial bore abuts or lies close to the annular duct, so that likewise in any rotated position of the pin it is possible to align the flow through the radial bore into the annular duct either to the left, or to the right, or to the center when the angle of rotation is zero.

A further, alternative embodiment of the direction controlling means consists of a rotatable cylindrical insert, which is arranged parallel to the axis of the supply duct. The insert in this embodiment is provided with an axial bore extending therethrough, which starts on the inlet side of the hot air in concentric relationship to the supply duct, and emerges on the outlet side into the annular duct with a defined offset in eccentric relationship to the supply duct.

The diameter of the axial bore may again correspond on the inlet side substantially to the diameter of the supply duct for the hot gas stream so as to prevent losses, or it may be greater than same. Likewise, it is again conceivable that on the outlet side the axial bore has the same diameter as, or a smaller diameter than the supply duct for the hot gas flow.

The outlet side of the axial bore preferably abuts or lies close to the annular duct and the outlet may possibly even project into the annular duct. By rotating the insert about its axis, i.e., the axis of the supply duct for the hot air flow, the flow through the axial bore into the annular duct is directed either to the left, or to the right, or to the center when the angle of rotation is zero.

The eccentricity by which the axial bore is offset between the inlet side and the outlet side, depends on the production process, and is preferably small in comparison with the other deflection of the hot air flow in the annular duct.

The insert is adjusted via suitable adjustment means from the outside of the texturing nozzle. Preferably, the insert is adjusted via a worm drive, in which the insert is used as a worm gear, and a worm actuatable from the outside rotates the worm gear and thus the insert.

A further, alternative embodiment of the direction controlling means comprises a translationally movable member, which will normally be shaped in a flow-favorable manner, for example, as an elongate cylinder. The axis of the cylinder will be arranged parallel to the axis of the annular duct, it being possible to displace this movable member perpendicularly to the axis of the annular duct and simultaneously perpendicularly to the axis of the supply duct. A suitable positioning of this movable member relative to the hot air flow allows to urge upon same a desired twist. More particularly, the lateral positioning of the movable member relative to the hot air flow, i.e., absent a flow around both sides of the movable member by the hot air stream, allows to achieve likewise a twist-imparting deflection of the hot air flow.

The above described movable member will be arranged close to the annular duct, and causes by its displacement along its possible movement the hot air flow to enter into the annular duct either to the right, or to the left, or in the center.

A further, alternative embodiment for imparting a twist may consist not only of deflectors or deflecting devices arranged at a fixed point to impart to the hot air flow the desired twist, shortly before its entry into the annular duct, but also that this twist impartation may be already generated during its flow through the supply duct. To this end, it is possible to achieve by a suitable configuration of the supply devices, such as, for example, by spatially arranged winding guide elements, a pulse transmission to the hot air flow, and thus a twist impartation to the yarn by a corresponding introduction of the air stream into the annular nozzle. Thus, the hot air stream flows already with a certain angle of deflection into the texturing nozzle, and is therein caused to enter into the annular duct at the desired angle of deflection. The guide elements may be adjustably mounted to permit adjustable control of the predominant direction of flow, or they may be fixed in the supply duct.

BRIEF DESCRIPTION OF THE DRAWINGS

Some of the objects and advantages of the present invention having been stated, others will appear as the description proceeds, when considered in conjunction with the accompanying drawings, in which.

DETAILED DESCRIPTION OF THE PREFERRED EMBODIMENTS

Figure 1:
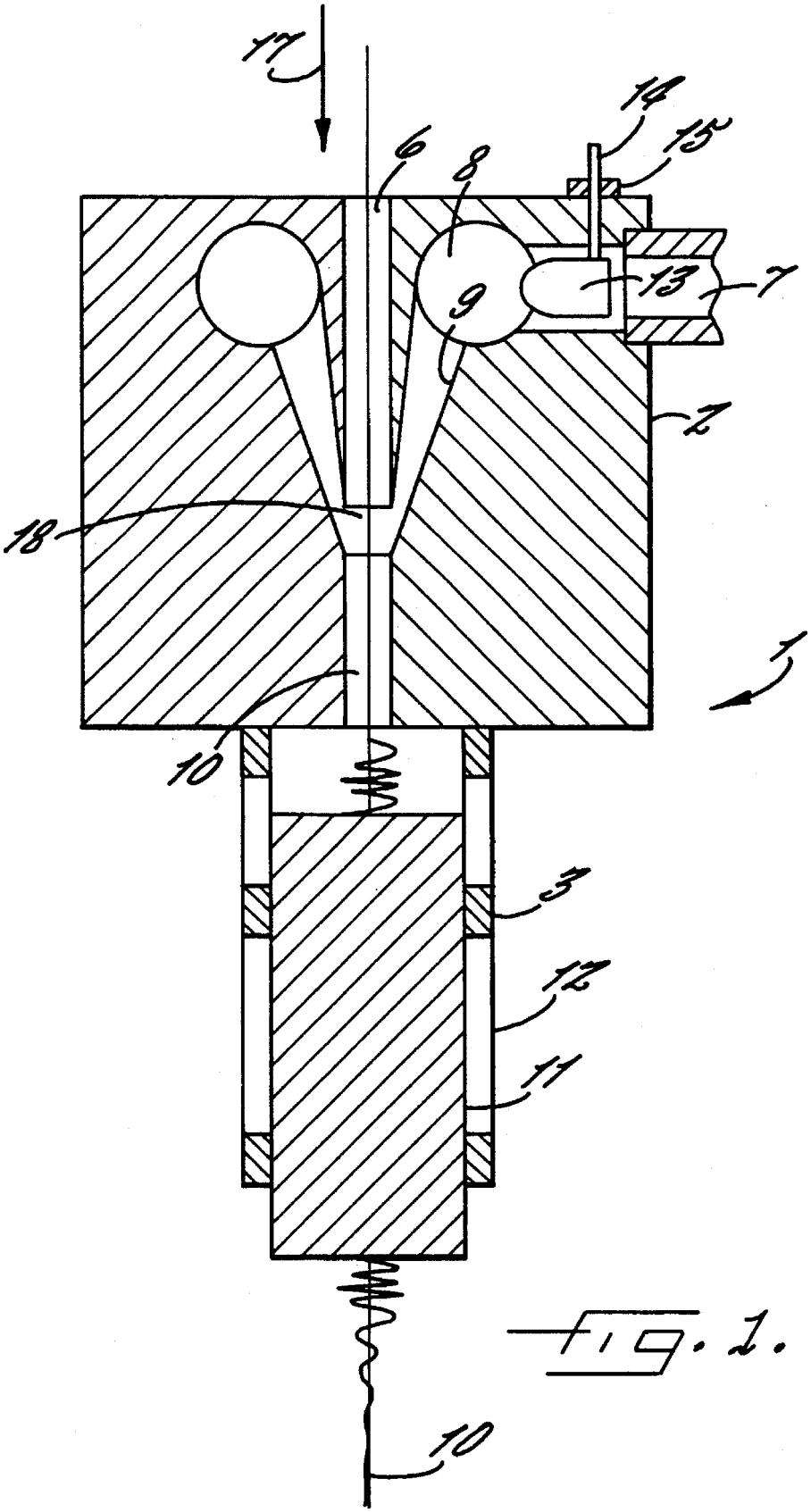
FIG. 1 is a partly schematic sectional view of a first embodiment of a texturing apparatus of the present invention, with a pivotal, preferably a flat baffle plate as a deflector.

Unless otherwise specified, the following description will always apply to all Figures.

A texturing apparatus 1 consists of a feed nozzle 2 and a stuffer box 3. The feed nozzle 2 consists of two, substantially identical nozzle halves 4 and 5, which can be tightly pressed against each other along a separating joint 16. Formed in both nozzle halves 4 and 5 is an annular duct 8. This annular duct 8 is preferably concentric with a yarn passageway 6, which is formed by communicating grooves respectively provided in the one and the other nozzle half 4, 5. Also, the annular duct 8 defines a plane which is disposed perpendicular to the direction of the yarn passageway 6.

The annular duct 8 receives via a supply duct 7 a heated fluid, i.e., hot air or hot vapor. The supply duct 7 communicates with the annular duct 8 in a transverse direction which is generally perpendicular to the direction of the yarn passageway 6, and which defines a plane of symmetry 19 which includes the yarn passageway 6.

Extending downwardly from the annular duct, and coaxially with respect to the yarn passageway 6, is a conical duct 9. This conical duct tapers in the direction 17 of the advancing yarn and terminates at is lower end via an annular gap 18 in the yarn passageway. The hot air jet entering at this point into the yarn passageway entrains the yarn 10 and advances it into the subjacent stuffer box 3. There, the yarn is accumulated and compressed to a yarn plug 11, and thereby crimped by the action of pressure and heat. The hot air escapes laterally through perforations 12 in the walls of stuffer box 3. Upon leaving the stuffer box 3, the plug 11 is disentangled to form a crimped yarn 10.

Figure 2:
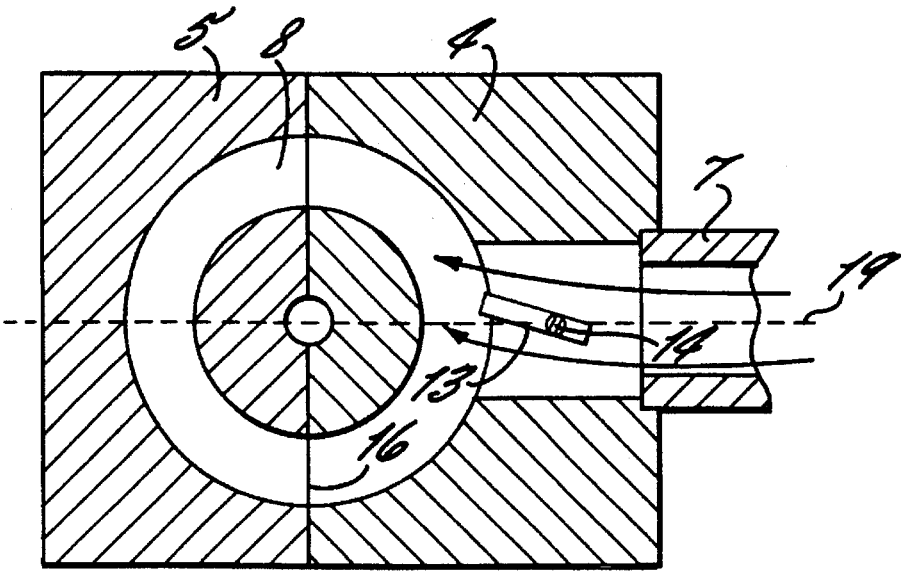
FIG. 2 is a top view of a deflector of FIG. 1 in one operative position.

As can be seen in FIG. 2, the hot air may have the tendency of assuming in annular duct 8 a preferred direction of flow to the left or right. In this assumed direction of flow, the hot air flows then through conical duct 9 into annular gap 18, and imparts here to the yarn the specific twist, which leads in part to a true twist, and in part to a false twist of the yarn. On the one hand, this twist is useful for a smooth advance of the yarn supplied to the feed nozzle. On the other hand, this twist prevents the yarn from opening in the stuffer box as the hot air expands, and from being fully exposed to and crimped by the action of heat and pressure. This will turn out to be noticeably disturbing in particular, when in a multiposition texturing machine the specific direction of flow differs from position to position, thereby developing a different twist tendency in the yarn.

Figure 3:
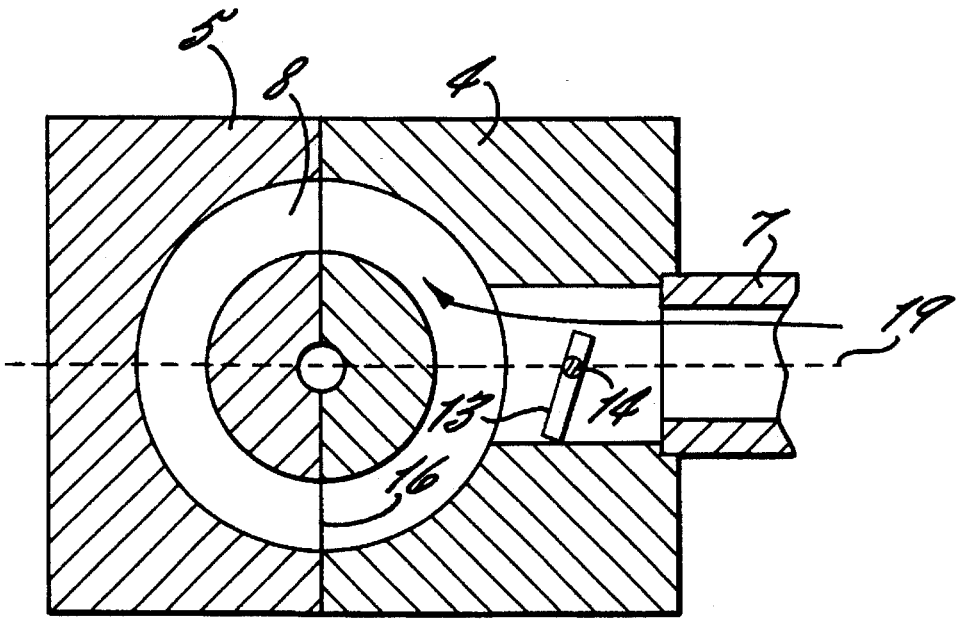
FIG. 3 is a top view of the deflector of FIG. 2 in a partially blocking position.

To alleviate this, a deflector 13 is provided in supply duct 7. This deflector, as shown in Figure 1, has the shape of a flat baffle plate, which is rotatable about the axis of post 14. This axis of rotation lies on the one hand in the plane of the deflector plate, and on the other hand parallel to the passageway 6 and the yarn advance direction 17. The deflector plate is arranged on a rotatable post 14, which can be adjusted from the outside and secured in position by a nut 15. As a result, it is possible to adjust the inclination of the deflector plate relative to the plane of symmetry 19 of supply duct 7, which simultaneously extends through the axis of the advancing yarn 10. The plane of symmetry 19 thus equals the plane of drawing in FIG. 1. This allows, within a certain range of adjustment, to direct the hot air stream, which is supplied through duct 7, into a certain direction, so that the hot air assumes a certain direction of flow in the annular duct. Likewise, it is possible to influence the intensity of this flow. If the deflector 13 is still further adjusted, it will partially close the supply duct on the one side of the plane of symmetry 19, as is shown in FIG. 3, thereby influencing likewise the direction of flow in the annular duct.

Figure 4:
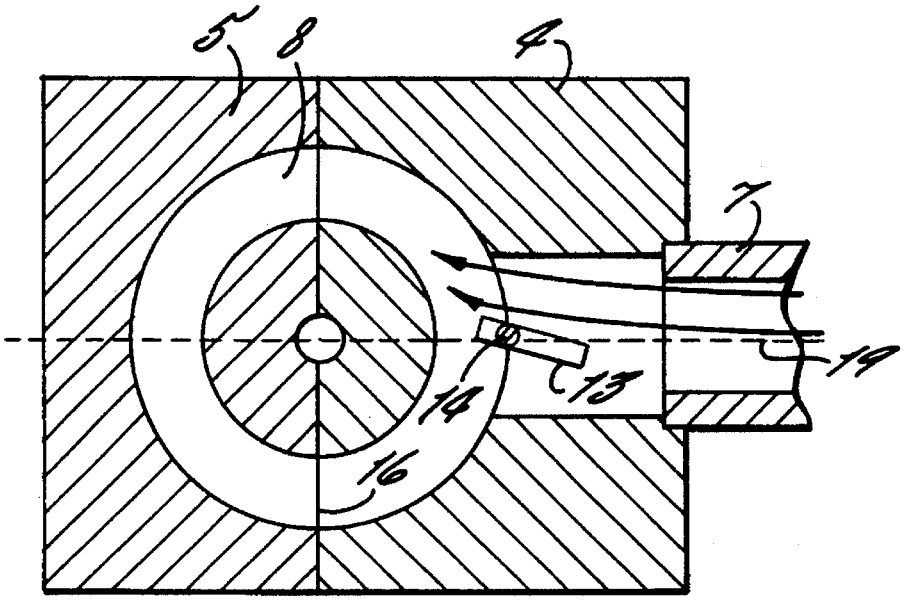
FIG. 4 is a top view of a deflector with a downstream positioned axis of rotation.
Figure 5:
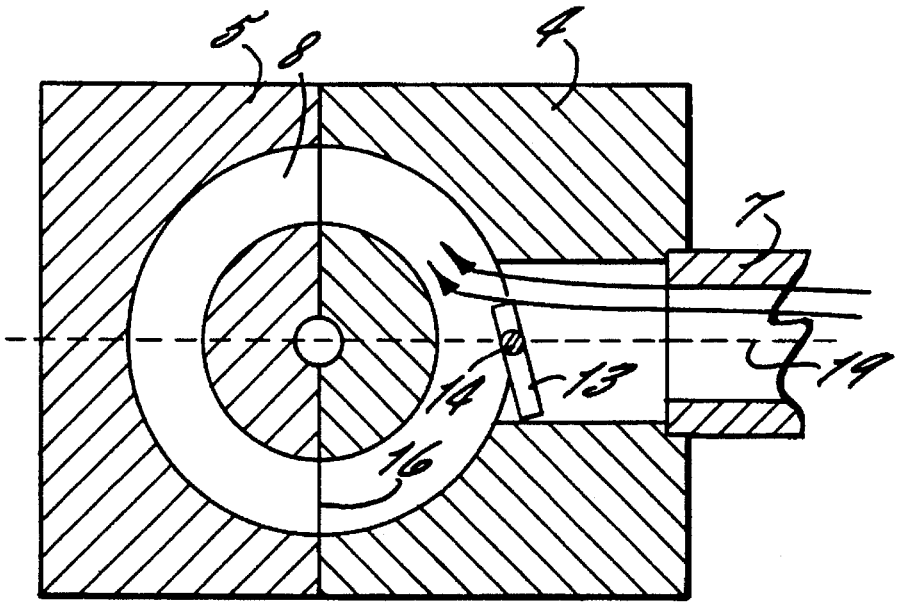
FIG. 5 is a top view of the deflector of FIG. 4 in a partially blocking position.

FIGS. 4 and 5 illustrate the deflector 13 as being rotatable about a post 14, which is located in the downstream end region of the deflector. As a result, the freely movable end of the deflector is directed oppositely to the arriving flow.

At its foremost tip, this free end possesses a defined leading edge for the arriving hot air. Consequently, at this point, the arriving hot air stream is divided as a function of the respective angle of incidence. A very fine adjustment of the general direction of inflow is thus made possible.

With its free end the deflector can be rotated by the incident flow, and in so doing moves through a sector angle, the apex of which is located downstream with respect to the leading edge of the deflector, and coincides with the axis of the rotating shaft.

In a randomly rotated position, the incident flow is presented with an impact surface, which deflects the incident "stream lines" in direction toward the axis of the rotating post, and thus in direction toward the generally intended direction of inflow.

As can be noted, an increasing angle of incidence of the deflector thus allows to block an increasing portion of the free cross section of flow in the supply duct, so that an increasing number of "stream lines" is thereby affected and deflected in the general direction of inflow.

Consequently, the arrangement of the axis of rotation at the downstream located end of the deflector allows to increase, as the deflection becomes greater, the hot air stream which is throughput, to the extent it assumes the intended direction of inflow.

It becomes therefore possible to influence at the same time the mechanical parameters, such as mass throughput and angle of deflection, which are relevant to the twist impartation.

In combination with the arrangement of the axis of rotation at the end of the deflector, this fact is of considerable advantage, since the cross section of the duct, which remains always open, is not influenced by the rotating motion. The cross section remaining always open, will then be predetermined only by the position of the axis of rotation in the channel.

Moreover, when the axis of rotation is arranged, as illustrated, in the end region of the supply duct, it will be accomplished that the deflected stream flows with the imparted twist into the annular duct directly after the deflection. This allows to largely avoid a loss-carrying impact of the hot air molecules upon the walls of the supply duct and/or annular duct, since the flow arrives in the annular duct substantially with a direction of inflow, which is predetermined by the duct geometry. There exists, at least at the moment of entry into the annular duct, a substantial flow component in the circumferential direction.

It is preferred that the axis of rotation be arranged either in the end region of the supply duct or in the region of transition between supply duct and annular duct. In both instances, a trailing edge forms on the deflector, the tangent of which predetermines the flow-off direction, in which the hot air enters into the annular duct. The below-described, alternative embodiments of the deflecting devices, which are arranged in the texturing nozzle, are based on the foregoing description of FIGS. 1 or 2–5. In these embodiments, only the deflector as well as its actuating elements are exchanged. Therefore, for a complete description, reference may be made to the foregoing text.

Figure 6:
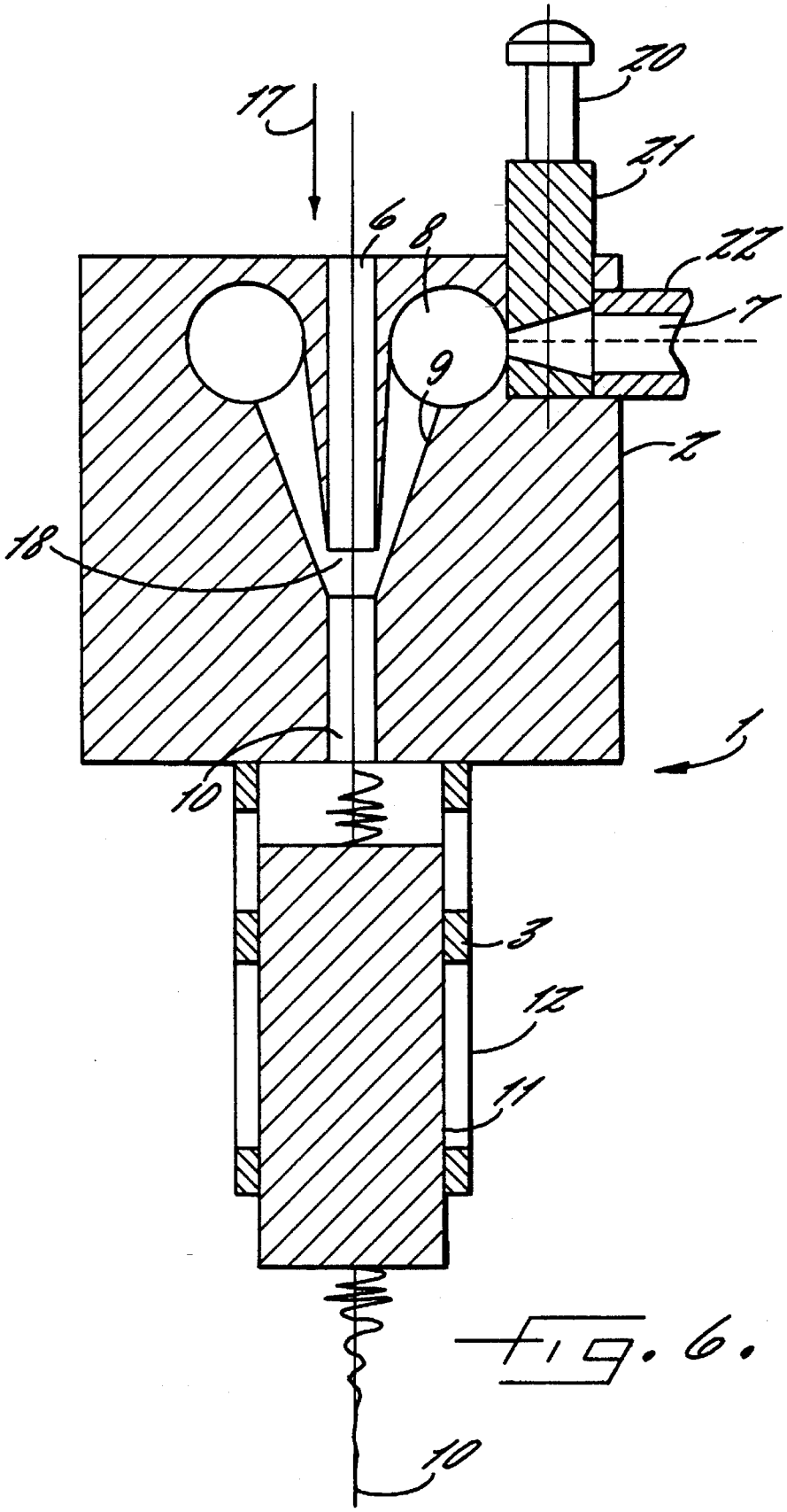
FIG. 6 shows an alternative embodiment of a texturing apparatus of the present invention, with a rotatable pin having a radial channel extending therethrough.

Shown in FIG. 6 is a deflector, which consists of a rotatable pin 21. Its axis of rotation is arranged such that is extends parallel to the axis of annular duct 8. The rotatable pin 21 possesses a radial bore 22 extending therethrough, the axis of which is again aligned parallel to the axis of supply duct 7 for the hot air. As a result, the hot air entering into supply duct 7 is guided through radial bore 22 into annular duct 8.

Figure 7:
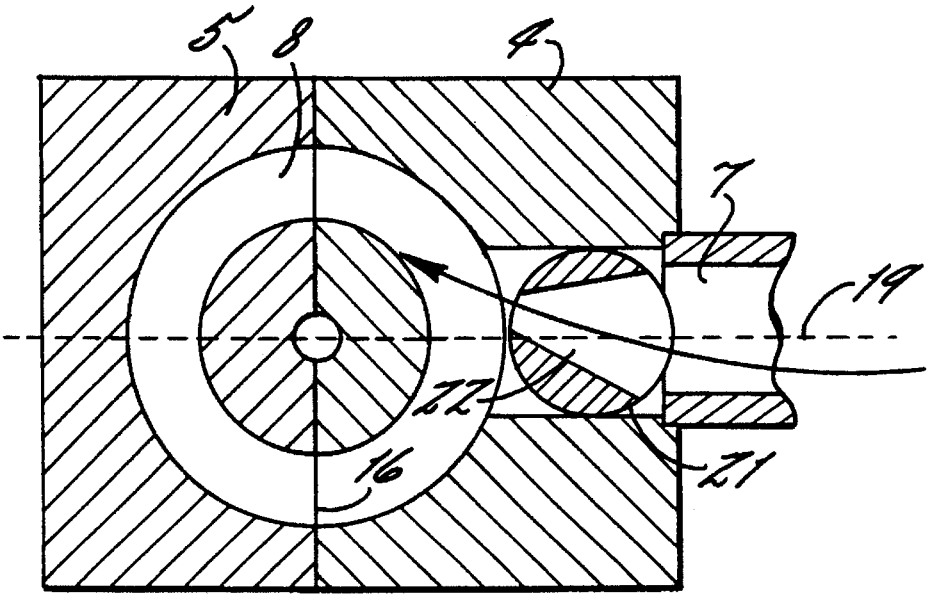
FIG. 7 is a top view of the deflector in accordance with FIG. 6.
Figure 8:
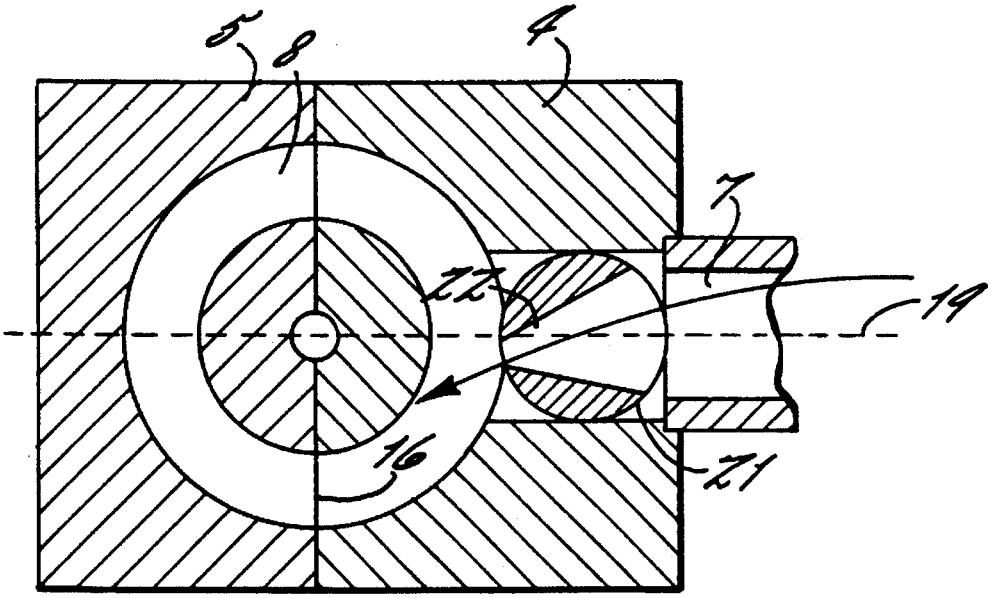
FIG. 8 is a top view of the deflector in accordance with FIG. 6 for an alternative direction of twist.

By rotating the pin 21 about its axis of rotation with the aid of rotating shaft 20, it becomes possible to rotate the radial bore relative to the axis of the supply duct (note FIGS. 7 and 8). This rotation allows the hot air flow to be given a predetermined direction, in which it is intended to enter into annular duct 8. Alternative directions of flow are on the one hand to the left, on the other hand to the right, and to the center of annular duct 8, when an angle of rotation is set to zero, namely when the axis of the radial bore is aligned parallel to the axis of supply duct 7.

Normally, the diameter of radial bore 22 is selected as a function of the diameter of supply duct 7. Conceivable are the following alternatives:

(a) A cylindrical radial bore having equal inlet and outlet diameters;

(b) The inlet diameter of the radial bore is greater than the outlet diameter, i.e., a conically narrowing radial bore is present; and (c) The inlet diameter of the radial channel is smaller than the outlet diameter, i.e., a "reverse" conical radial bore is present, which influences the hot air flow as a diffusor.

With respect to the inlet diameter of radial bore 22 it is always necessary to make sure that the flow from supply duct 7 into radial bore 22 is free of losses in any possible rotated position. Therefore, as a rule, it will be necessary to select the supply duct 7 smaller than the inlet diameter of the radial bore. Shown in FIGS. 7 and 8 are the two alternative positions of pin 21 for the flow to the right or to the left. A conical radial bore 22 is illustrated, the inlet diameter of which is greater than its outlet diameter.

Figure 9:
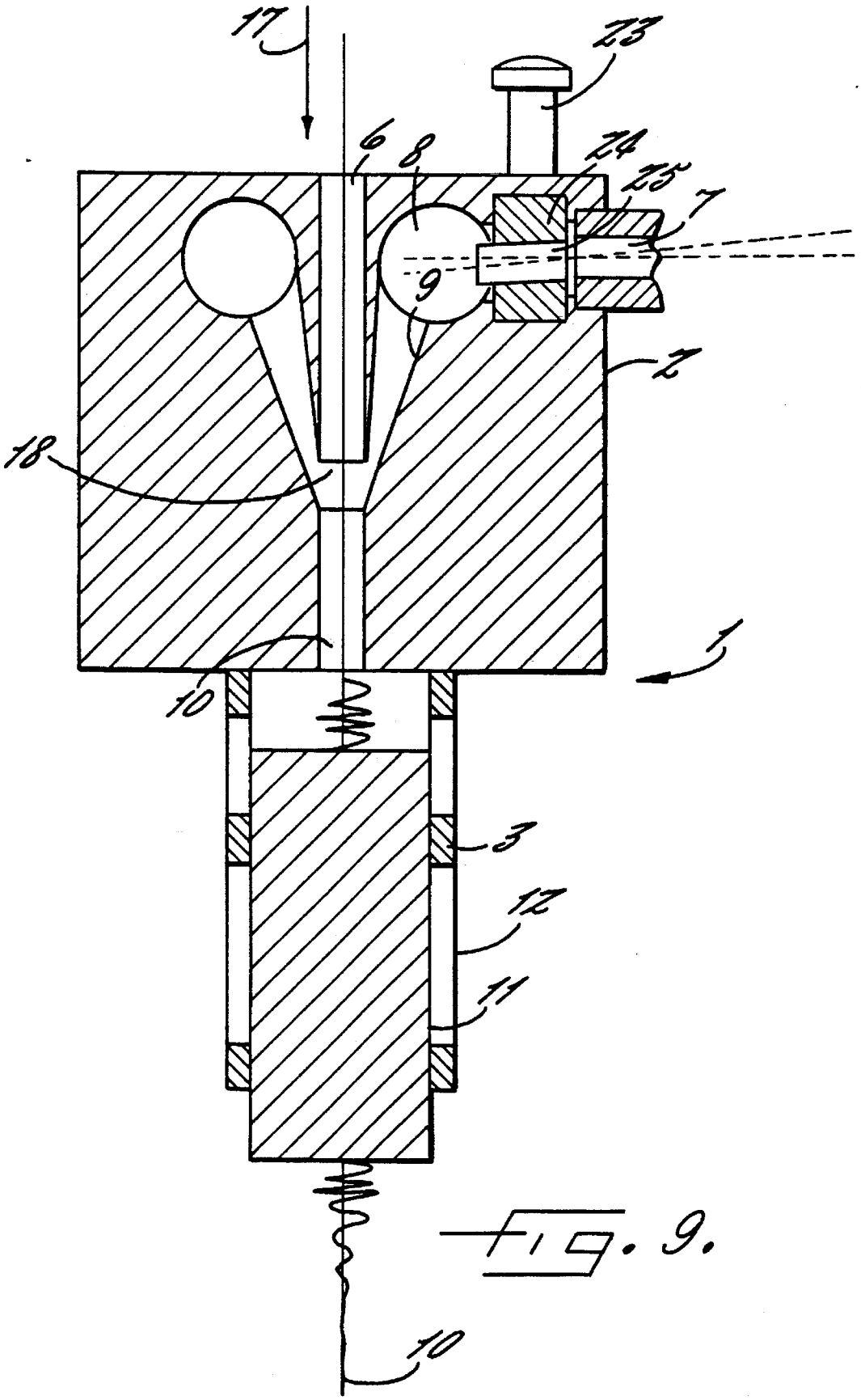
FIG. 9 shows a further embodiment of a texturing apparatus of the present invention, with an insert having an axial channel extending therethrough, which is adjusted by means of a set screw with a worm.

Shown in FIG. 9 is a further, alternative embodiment of the deflector. It is in this instance a rotatable, cylindrical insert 24, which is arranged parallel to the axis of supply duct 7. An axial bore 25 extends through this deflector, which starts on its inlet side for the hot air in concentric relationship with supply duct 7, and emerges on its outlet side into annular duct e with a defined offset in eccentric relationship to the axis of supply duct 7. This rotation of the axial bore allows to achieve, when deflecting insert 24 is adjusted to different angles of rotation, a deflection of the hot air flow to the left in the direction of flow, to the right in the direction of flow, or centrically upward or downward in the direction of flow. The foregoing thoughts with respect to the selection of diameter for the radial bore 22 of FIG. 6 apply analogously also to axial bore 25 of FIG. 9. Also conceivable in this instance are cylindrical or conical embodiments of the axial bore.

The eccentricity of axial bore 25 between the inlet diameter and outlet diameter of insert 24 is normally selected as a function of the production process and is preferably small, when compared with the other deflection of the hot air flow in annular duct 8.

Figure 10:
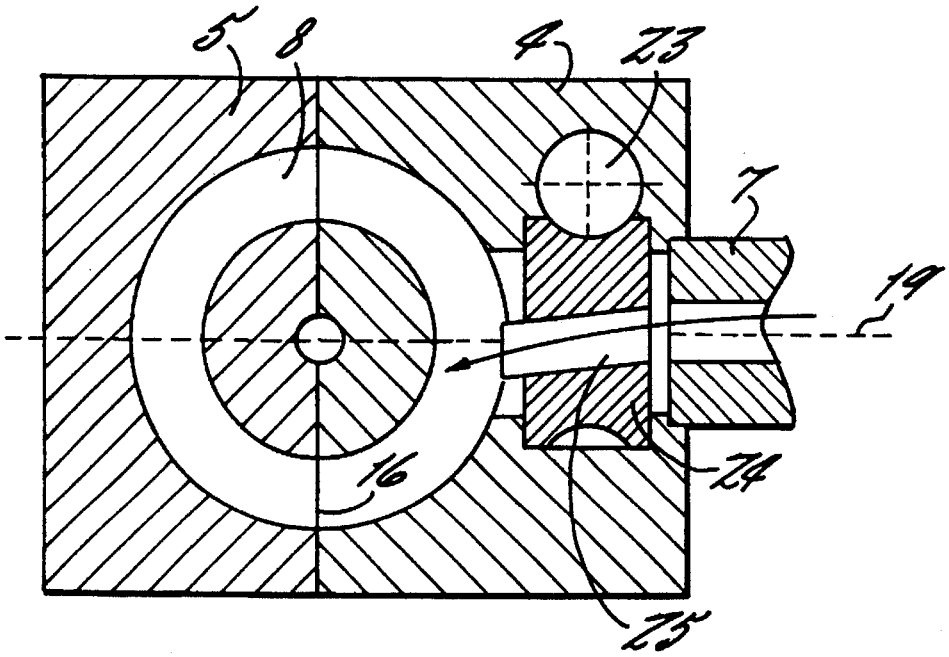
FIG. 10 is a top view of the deflector in accordance with FIG. 9.
Figure 11:
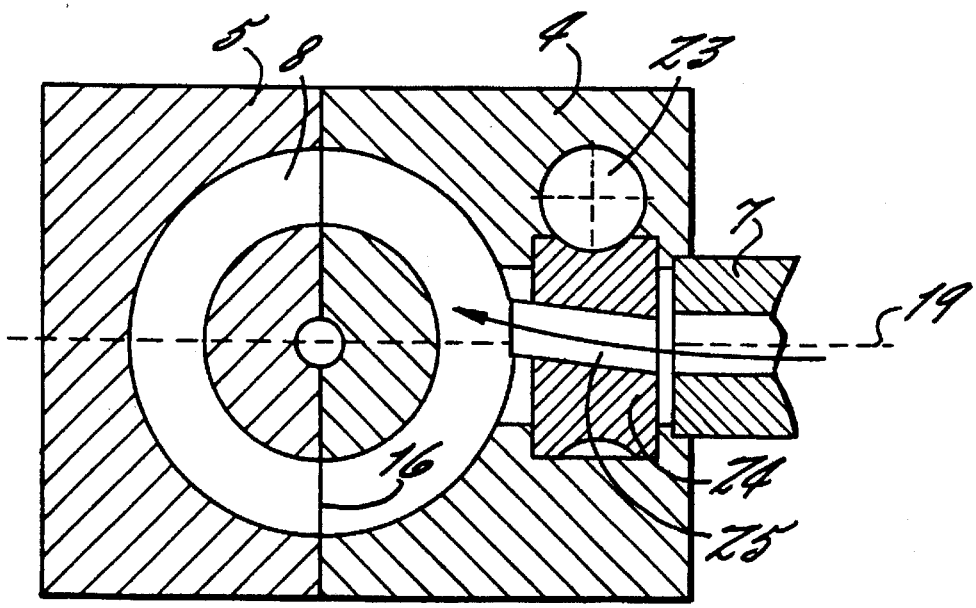
FIG. 11 is a top view of the deflector in accordance with FIG. 9 for an alternative direction of twist.

The rotation of deflector insert 24 about its axis may be performed via suitable adjustment devices, preferably from the outside of the texturing nozzle. A preferred embodiment for this purpose may be a worm drive, in which deflector insert 24 is used as a worm, and is provided on its exterior with a worm gear tooth system. An externally actuatable worm 23 allows to rotate the worm gear and thus the insert about the axis of the deflector insert. Shown in FIGS. 10 and 11 are two positions of the deflector insert, with FIG. 10 illustrating a deflection of the flow to the left in the direction of flow, and FIG. 11 a deflection of the flow to the right in the direction of flow. In the Figures, the drive worm 23 is indicated only as a sectional plane. The axial bore 15 is shown as a cylindrical channel, with the outlet side of the bore projecting slightly into annular duct 8.

Figure 12:
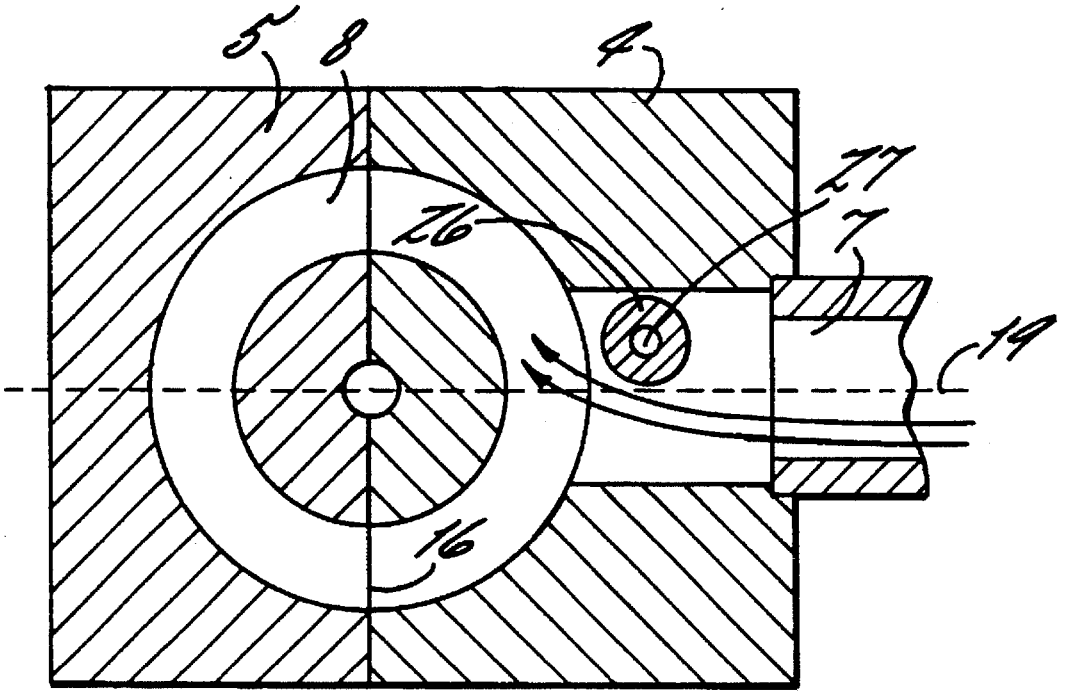
FIG. 12 is a top view of yet a further texturing apparatus of the present invention, with a cylindrical deflector.

In the embodiment shown in FIG. 12, the hot air flows around an elongate, in the example cylindrical deflector 26, which is arranged on a sliding pin 27, the latter being actuatable from the outside. As a result, the deflector 26 can be displaced perpendicularly to the axis of supply duct 7. In this embodiment, use is made of the lifting surface or airfoil effect, and as a result of the configuration of deflector 26, a vacuum is produced in the location of deflector 26 in supply duct 7, when air flows around deflector 26, behind (when viewed in direction of flow) the deflector 26, whereby the hot air undergoes a deflection in the respectively desired direction. Thus, when pin 27 is displaced, and thus deflector 26, the desired twist is imparted to the hot air, as it enters into annular duct 8.

It should be emphasized that a body utilizing this effect need not be absolutely symmetrical in rotation. In the place of the circular cylinder shown in FIG. 12, it is also possible to use other body shapes, as long as the desired flow pattern is obtained, when they are surrounded by a flow, and the hot air flow becomes thereby controllable.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for texturing an advancing yarn with a pressurized heating fluid and comprising:

a nozzle including a passageway through which the yarn is to advance at high speed from an inlet end to an outlet end of said passageway;

duct means for conducting a pressurized heating fluid into said passageway during operation of said apparatus, and including an annular duct surrounding said yarn passageway in said nozzle, a supply duct communicating with said annular duct, and a conical duct extending from said annular duct to said yarn passageway;

a perforated stuffer box disposed adjacent the outlet end of said yarn passageway for receiving and forming a compressed plug from the advancing yarn exiting from said passageway; and means mounted in said supply duct for adjustably controlling the direction of flow of the heating fluid into said annular duct.

2. The apparatus as defined in claim 1 wherein said annular duct defines a plane disposed perpendicular to the direction of the yarn passageway, and said supply duct communicates with said annular duct in a transverse direction which is generally perpendicular to the direction of the yarn passageway and which defines a plane of symmetry which includes the yarn passageway.

3. The apparatus as defined in claim 2 wherein said direction controlling means comprises a generally flat baffle plate which is mounted for rotation about a pivotal axis which is parallel to the direction of the yarn passageway and disposed within said plane of symmetry, and such that the direction of flow of the heated fluid into said annular duct may be adjusted by rotation of said flat baffle plate.

4. The apparatus as defined in claim 3 wherein said flat baffle plate is configured so that it is adapted to partially or fully close the supply duct on one side of said plane of symmetry.

5. The apparatus as defined in claim 4 wherein said flat baffle plate includes an upstream end and a downstream end, and wherein said pivotal axis is located adjacent said downstream end.

6. The apparatus as defined in claim 5 wherein said flat baffle plate is located immediately adjacent said annular duct.

7. The apparatus as defined in claim 2 wherein said direction controlling means comprises a deflector pin which is rotatably mounted so as to extend across said supply duct and substantially close the same, and a radial bore extending through said deflector pin which communicates with said supply duct, and such that the direction of flow of the heated fluid into said annular duct may be adjusted by rotation of the deflector pin.

8. The apparatus as defined in claim 7 wherein said bore of said deflector pin defines an inlet end having a diameter which at least substantially corresponds to the diameter of said supply duct, and an outlet and having a diameter which is not greater than the diameter of said inlet end.

9. The apparatus as defined in claim 8 wherein said outlet end of said bore of said deflector pin is located immediately adjacent said annular duct.

10. The apparatus as defined in claim 2 wherein said supply duct defines a transverse axis, and wherein said direction controlling means comprises a cylindrical insert which is mounted for rotation about said transverse axis of the supply duct, and said insert includes an axial bore extending therethrough and having an outlet end which is eccentric to said transverse axis of the supply duct.

11. The apparatus as defined in claim 10 wherein said inlet end of said bore of said cylindrical insert is at least substantially equal to the diameter of said supply duct, and said outlet end of said bore of said cylindrical insert is smaller than the diameter of said supply duct.

12. The apparatus as defined in claim 10 further including means for selectively rotating the cylindrical insert about its axis of rotation, such that the direction of flow of the heated fluid into said annular duct may be adjusted by rotation of the cylindrical insert.

13. The apparatus as defined in claim 12 wherein said means for selectively rotating said cylindrical insert includes a worm gear formed on said cylindrical insert, and a worm drive which operatively engages the worm gear of the cylindrical insert.

14. The apparatus as defined in claim 12 wherein said outlet end of said bore of said cylindrical insert is located immediately adjacent said first annual duct.

15. The apparatus as defined in claim 2 wherein said direction controlling means comprises an elongate deflector which extends across said supply duct in a direction parallel to the direction of the yarn passageway, and which is mounted for translation in a direction perpendicular to the direction of the yarn passageway.

16. The apparatus as defined in claim 15 wherein said elongate deflector is positioned immediately adjacent said annular duct, such that the direction of flow of the heated fluid into said annular duct may be adjusted by translation of the elongate deflector.

17. The apparatus as defined in claim 1 wherein said direction controlling means comprises spatially arranged guide elements mounted in said supply duct for imparting a pulse transmission to the heating fluid passing therethrough and thereby causing the heating fluid to enter into said annular duct in a desired direction.

18. An apparatus for texturing an advancing yarn with a pressurized heating fluid and comprising:

a nozzle including a passageway through which the yarn is to advance at high speed from an inlet end to an outlet end of said passageway;

duct means for conducting a pressurized heating fluid into said passageway during operation of said apparatus, and including an annular duct surrounding said yarn passageway in said nozzle, a supply duct communicating with said annular duct, and a conical duct extending from said annular duct to said yarn passageway;

a perforated stuffer box disposed adjacent the outlet end of said yarn passageway for receiving and forming a compressed plug from the advancing yarn exiting from said passageway; and means mounted in said supply duct for controlling the direction of flow of the heating fluid into said annular duct and comprising spatially arranged guide elements fixedly mounted in said supply duct for imparting a pulse transmission to the heating fluid passing therethrough.

* * * * *